US009280940B2

(12) United States Patent
Chen et al.

(10) Patent No.: US 9,280,940 B2
(45) Date of Patent: Mar. 8, 2016

(54) LIQUID CRYSTAL DISPLAY DEVICE, FOUR-COLOR CONVERTER, AND CONVERSION METHOD FOR CONVERTING RGB DATA TO RGBW DATA

(71) Applicant: Shenzhen China Star Optoelectronics Technology Co., Ltd., Shenzhen, Guangdong (CN)

(72) Inventors: Lixuan Chen, Guangdong (CN); Chih-tsung Kang, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 62 days.

(21) Appl. No.: 14/386,789

(22) PCT Filed: Aug. 1, 2014

(86) PCT No.: PCT/CN2014/083586

§ 371 (c)(1),
(2) Date: Sep. 19, 2014

(87) PCT Pub. No.: WO2016/008177

PCT Pub. Date: Jan. 21, 2016

(65) Prior Publication Data

US 2016/0019851 A1 Jan. 21, 2016

(51) Int. Cl.
*G09G 3/36* (2006.01)

(52) U.S. Cl.
CPC ..... *G09G 3/3607* (2013.01); *G09G 2300/0452* (2013.01)

(58) Field of Classification Search
CPC ..... G09G 3/3607; G09G 2300/0452; G09G 2340/06
See application file for complete search history.

(56) References Cited

U.S. PATENT DOCUMENTS

| | | | | |
|---|---|---|---|---|
| 6,608,632 | B2 * | 8/2003 | Daly | G09G 3/2003 345/611 |
| 7,986,291 | B2 * | 7/2011 | Van Mourik | G09G 3/2003 345/88 |
| 2004/0046725 | A1 * | 3/2004 | Lee | G09G 3/3607 345/88 |
| 2005/0083352 | A1 * | 4/2005 | Higgins | G09G 3/2003 345/690 |
| 2005/0099426 | A1 * | 5/2005 | Primerano | G09G 3/3208 345/589 |
| 2006/0146351 | A1 * | 7/2006 | Lo | G09G 3/3607 358/1.9 |
| 2007/0152953 | A1 * | 7/2007 | Hong | G09G 3/3413 345/102 |
| 2009/0046307 | A1 * | 2/2009 | Kwak | G09G 5/02 358/1.9 |
| 2013/0120472 | A1 * | 5/2013 | Byun | G09F 9/30 345/690 |

(Continued)

*Primary Examiner* — Claire X Pappas
*Assistant Examiner* — Robert Stone
(74) *Attorney, Agent, or Firm* — Andrew C. Cheng

(57) ABSTRACT

An LCD device includes a four-color converter for converting an original RGB data into three grayscale values, executing a white balance process to the three grayscale values, and confirming a maximum value MAX (Ri, Gi, Bi) and a minimum value of the three white-balanced grayscale values Ri, Gi, and Bi, wherein, when the minimum value is greater than 0, determining that if the three data of the original RGB data are equal, and when they are equal, utilizing a formula Wo=Bi; Ro=Ri×Wo/MAX(Ri, Gi, Bi)+Ri−Wo; Go=Gi×Wo/MAX (Ri, Gi, Bi)+Gi−Wo; Bo=0 to calculate the output grayscale values Ro, Go, Bo, and Wo in the RGBW data. The device also includes a data driver for processing the RGBW data provided by the four-color converter to generate analog type data signals, a scanning driver for sequentially generating scanning signals, and an LCD panel for displaying colors.

9 Claims, 3 Drawing Sheets

(56) References Cited

U.S. PATENT DOCUMENTS

2014/0267442 A1* 9/2014 Lin ..... G09G 3/3208 345/690

2015/0312542 A1* 10/2015 Suginohara ..... G09G 3/3607 345/603

2015/0325183 A1* 11/2015 Chen ..... G09G 3/3607 345/694

* cited by examiner

LIQUID CRYSTAL DISPLAY DEVICE, FOUR-COLOR CONVERTER, AND CONVERSION METHOD FOR CONVERTING RGB DATA TO RGBW DATA

BACKGROUND OF THE INVENTION

1. Field of the Invention

The present invention relates to the liquid crystal display field, and particularly to a liquid crystal display device, a four-color converter, and a conversion method for converting a RGB data to a RGBW data.

2. Description of Related Art

Currently, in a display device having a liquid crystal display panel (LCD) or an organic light emitting diode display panel (OLED), a pixel is formed by a red (R) subpixel, a green (G) subpixel, and a blue (B) subpixel. Through controlling the grayscale value of each subpixel, a color required to be displayed is mixed. With the development of the information technology, various requirements for the display panel are increased. High light transmittance, low power consumption, good image quality has become a people's demand for the display panel. The light transmittance and mixing efficiency of the current RGB color mixing method are lower such that the power consumption of the display panel is large so as to limit product optimization of the display panel. Therefore, a technology that a pixel is formed by a red (R) subpixel, a green (G) subpixel, a blue (B) subpixel, and a fourth subpixel is generated to improve the display quality of the RGB display panel.

More commonly, the increased fourth subpixel is a white (W) subpixel, that is, a pixel is formed by a red (R) subpixel, a green (G) subpixel, a blue (B) subpixel, and a white (W) subpixel. The display device having a RGBW display panel require converting an original RGB date to a RGBW data required to be displayed in order to drive the RGBW display panel and displaying. However, the current method used to convert the original RGB date to the RGBW data usually has to satisfy a relationship: W=R+G+B.

FIG. 1 is a light transmittance spectrum diagram of a W subpixel according to the conventional art. FIG. 2 is a light transmittance spectrum diagram of an R subpixel, a G subpixel, and a B subpixel according to the conventional art. With reference to the FIG. 1 and FIG. 2, in the actual situation, the backlight (such as a blue light) generated by the backlight module is directly emitted from the W subpixel (usually formed by a transparent photoresist). The relationship of W=R+G+B for each subpixel is difficult to meet. Furthermore, the light emitted from the W subpixel is highly similar with the light emitted from the B subpixel. Because the combined effect of the light emitted from the W subpixel and the light emitted from the B subpixel, the white color spectrum displayed by the RGBW display panel cannot be located in a normal range such that the chromaticity displayed by the RGBW display panel is abnormal.

SUMMARY OF THE INVENTION

In order to solve the above technical problems, an objective of the present invention is to provide: a liquid crystal display device, comprising: a four-color converter for converting an original red-green-blue (RGB) data having three data of the three colors into three grayscale values of the three colors, executing a white balance process to the three grayscale values of the three colors, and confirming maximum and minimum values of the three white-balanced grayscale values of the three colors, wherein, when the minimum value is greater than 0, determining that if the three data of the original RGB data are equal, and when the three data of the original RGB data are equal, utilizing a following formula 1 to calculate output grayscale values of four colors in a red-green-blue-white (RGBW) data required to be displayed, $$Wo=Bi;$$

$$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=0; \qquad \text{[formula 1]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color;

a data driver configured for processing the RGBW data provided by the four-color converter in order to generate analog type data signals; a scanning driver configured for sequentially generating scanning signals; and a liquid crystal panel for displaying colors by the analog type data signals provided by the data driver and the scanning signals provided by the scanning driver.

Furthermore, the four-color converter is further configured to calculate the output grayscale values of the four colors in the RGBW data required to be displayed utilizing the following formula 2 when the minimum value is greater than 0, and at least two data of the original RGB data are not equal, $$Wo=\mathrm{MAX}^2(Ri,Gi,Bi)/255;$$

$$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=Bi\times Wo/\mathrm{MAX}(Ri,Gi,Bi)+Bi-Wo. \qquad \text{[formula 2]}$$

Furthermore, the four-color converter is further configured to calculate the output grayscale values of the four colors in the RGBW data required to be displayed utilizing the following formula 3 when the minimum value is equal to 0, $$Wo=0;\ Ro=Ri;\ Go=Gi;\ Bo=Bi. \qquad \text{[formula 3]}$$

Another objective of the present invention is to provide: a four-color converter, comprising: a grayscale conversion section configured for receiving an original red-green-blue (RGB) data having three data of the three colors, and converting the original RGB data into three grayscale values of the three colors; a white balance section configured receiving the three grayscale values of the three colors from the grayscale conversion section, and executing a white balance process to obtain three white-balanced grayscale values of the three colors; a comparing section configured for comparing the three white-balanced grayscale values of the three colors in order to determine maximum and minimum values of the three white-balanced grayscale values of the three colors; a first determination section configured for determining that if the minimum value is greater than 0 or equal to 0; a second determination section configured for determining that if the three data of the original RGB data are equal when the first determination section determines that the minimum value by is greater than 0; a white determination section configured for setting the white-balanced grayscale value of the green color as an output grayscale value of the white color in a red-green-blue-white (RGBW) data required to be displayed when the second determination section determines that the three data of the original RGB data are equal; and a three-color calculation section configured for calculating three output grayscale values of the three colors in the RGBW data required to be displayed by utilizing the following formula 1, $$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=0; \qquad \text{[formula 1]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color.

Furthermore, the white determination section is further configured for calculating the output grayscale value of the white color in the RGBW data required to be displayed by utilizing the following formula 2 when second determination section determines that at least two data of the original RGB data are not equal, $$Wo=\mathrm{MAX}^2(Ri,Gi,Bi)/255; \text{ and} \qquad \text{[formula 2]}$$

the three-color calculation section is further configured for calculating the three output grayscale values of the three colors in the RGBW data required to be displayed by utilizing the following formula 3, $$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=Bi\times Wo/\mathrm{MAX}(Ri,Gi,Bi)+Bi-Wo. \qquad \text{[formula 3]}$$

Furthermore, the white determination section is further configured for calculating the output grayscale value of the white color in the RGBW data required to be displayed by utilizing the following formula 4 when the minimum value is equal to 0, $$Wo==0; \text{ and} \qquad \text{[formula 4]}$$

the three-color calculation section is further configured for calculating the three output grayscale values of the three colors in the RGBW data required to be displayed by utilizing the following formula 5, $$Ro=Ri;\ Go=Gi;\ Bo=Bi. \qquad \text{[formula 5]}$$

Another objective of the present invention is to provide: a conversion method for converting a red-green-blue (RGB) data to a red-green-blue-white (RGBW) data, comprising: receiving an original red-green-blue (RGB) data having three data of the three colors, and converting the original RGB data into three grayscale values of the three colors, wherein, the three colors include a red color, a green color, and a blue color, executing a white balance process to the three grayscale values of the three colors to obtain three white-balanced grayscale values of the three colors; comparing the three white-balanced grayscale values of the three colors in order to determine maximum and minimum values of the three white-balanced grayscale values of the three colors; determining that if the minimum value is greater than 0 or equal to 0; if the minimum value is greater than 0, determining that if the three data of the original RGB data are equal; if the three data of the original RGB data are equal, utilizing a following formula 1 to calculate output grayscale values of the four colors in the RGBW data required to be displayed, $$Wo=Bi;$$

$$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=0; \qquad \text{[formula 1]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color.

Furthermore, if the minimum value is greater than 0 and at least two data of the original RGB data are not equal, utilizing a following formula 2 to calculate output grayscale values of the four colors in the RGBW data required to be displayed, $$Wo=\mathrm{MAX}^2(Ri,Gi,Bi)/255;$$

$$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=Bi\times Wo/\mathrm{MAX}(Ri,Gi,Bi)+Bi-Wo. \qquad \text{[formula 2]}$$

Furthermore, if the minimum value is equal to 0, utilizing a following formula 3 to calculate output grayscale values of the four colors in the RGBW data required to be displayed, $$Wo=0;\ Ro=Ri;\ Go=Gi;\ Bo=Bi. \qquad \text{[formula 3]}$$

The present invention enables each subpixel of the liquid crystal display panel satisfies the relation W=R+G+B when displaying. In addition, the liquid crystal display panel displays the spectrum of the white color in the normal range and the chromaticity of white color being displayed is normal.

DETAILED DESCRIPTION OF THE PREFERRED EMBODIMENT

The following content combines with the drawings and the embodiment for describing the present invention in detail. It is obvious that the following embodiments are only some embodiments of the present invention. For the skilled persons of ordinary skill in the art without creative effort, the other embodiments obtained thereby are still covered by the present invention.

Figure 1:
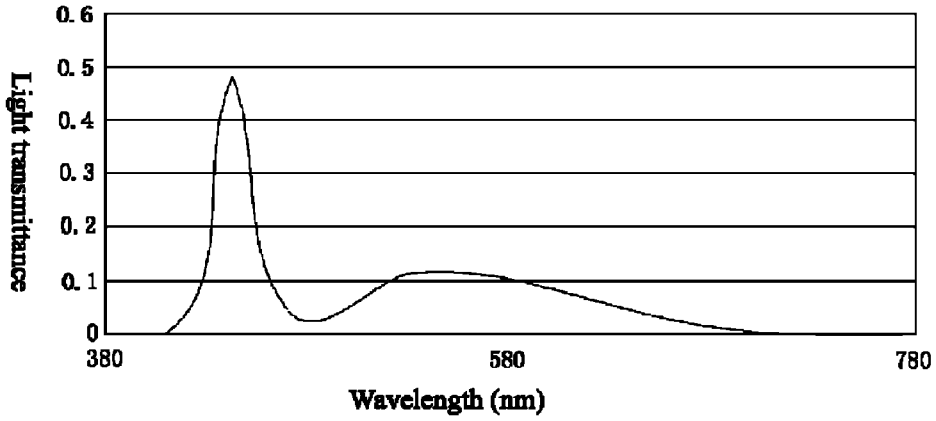
FIG. 1 (Prior art)
FIG. 1 is a light transmittance spectrum diagram of a W subpixel according to the conventional art.
Figure 2:
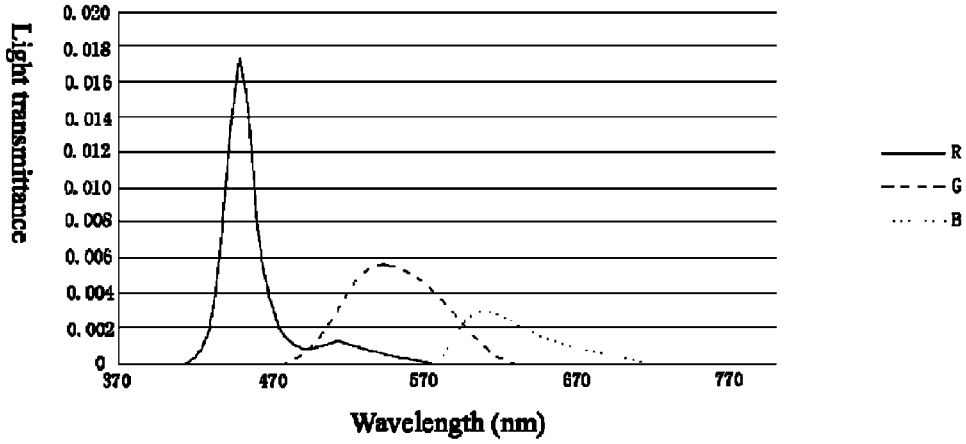
FIG. 2 (Prior art)
FIG. 2 is a light transmittance spectrum diagram of an R subpixel, a G subpixel, and a B subpixel according to the conventional art.
Figure 3:
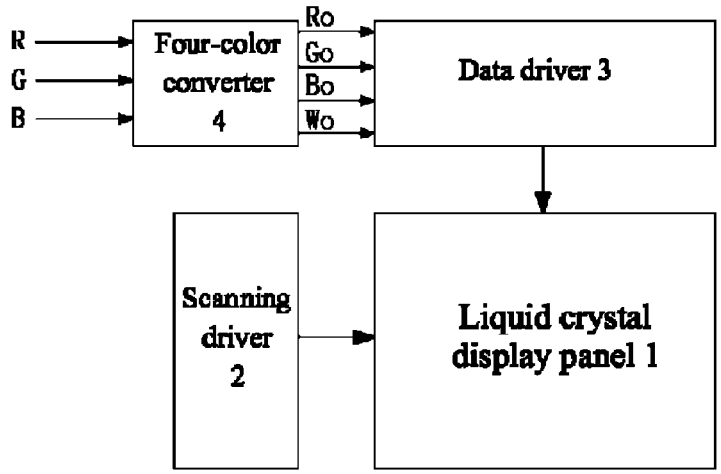
FIG. 3 is a block diagram of a liquid crystal display device according to an embodiment of the present invention.
Figure 4:
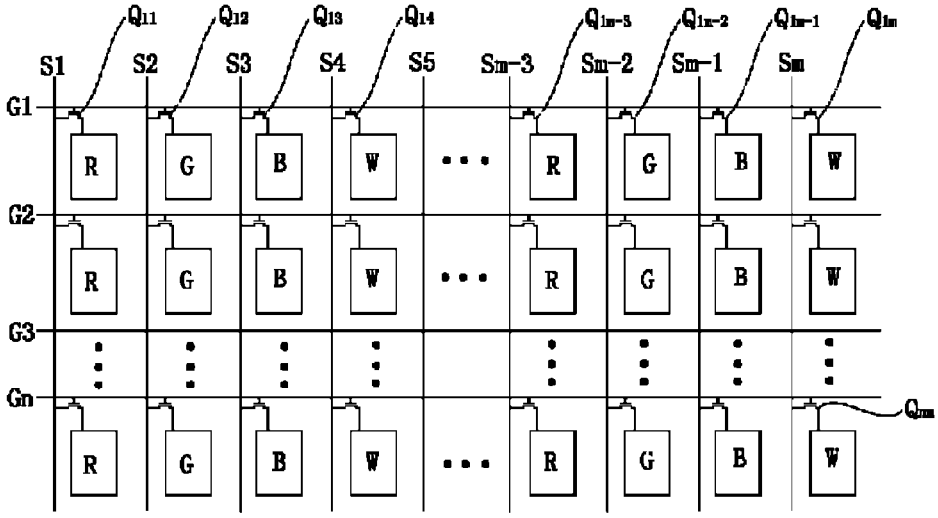
FIG. 4 is a structure diagram of a liquid crystal display device according to an embodiment of the present invention.
Figure 5:
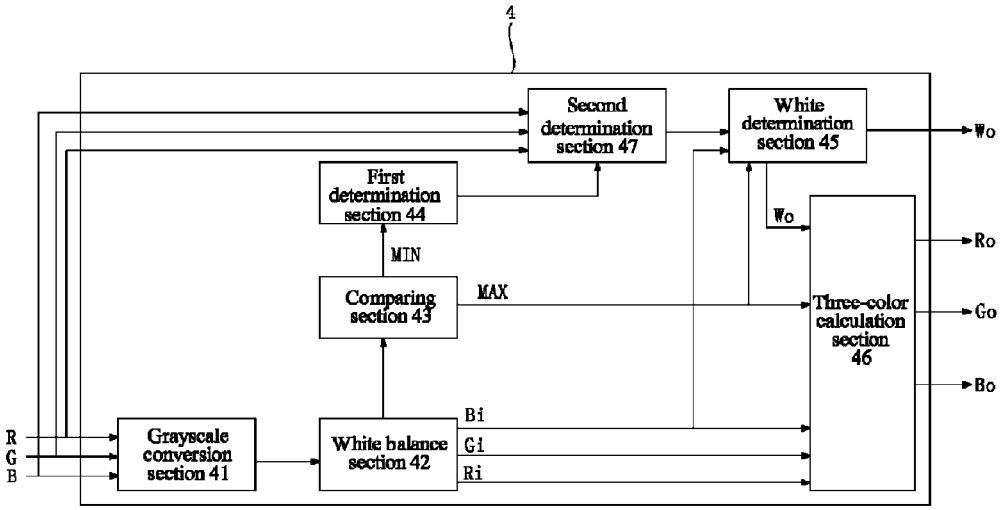
FIG. 5 is a block diagram of a four-color converter according to an embodiment of the present invention.

FIG. 3 is a block diagram of a liquid crystal display device according to an embodiment of the present invention; FIG. 4 is a structure diagram of a liquid crystal display device according to an embodiment of the present invention; and FIG. 5 is a block diagram of a four-color converter according to an embodiment of the present invention.

With reference to FIG. 3 and FIG. 4, a liquid crystal display panel 1 includes multiple scanning lines G1 to Gm (wherein, m is a natural number) extending along a row direction and multiple data lines S1 to Sn extending along a column direction. The scanning lines G1 to Gm are all connected to the scanning driver 2, and the data lines S1 to Sn are all connected to the data driver 3. The liquid crystal display panel 1 also includes multiple red (R) subpixels, multiple green (G) subpixels, multiple blue (B) subpixels, and multiple white (W) subpixels.

Each of the red (R) subpixels, each of the green (G) subpixels, each of the blue (B) subpixels, or each of the white (W) subpixels is disposed in an area defined by scanning lines Gi and Gi+1 (wherein, i is 1 to m) and data lines Sj to Sj+1 (wherein, j is 1 to n). Wherein, one red (R) subpixel, one green (G) subpixel, one blue (B) subpixel, and one white (W) subpixel form one pixel.

Thin film transistors (TFT) Qij are respectively disposed at each intersection locations of the scanning lines Gi and the data lines Sj.

Furthermore, the scan lines Gi are respectively connected to gates of the thin film transistors Qij, the data lines Sj are respectively connected to sources of the thin film transistors Qij, and a pixel electrode of each of the subpixels (R, G, B, or W subpixel) is connected to a drain of the corresponding thin film transistor Qij.

A common electrode corresponding to the pixel electrode of each of the subpixels is connected to a common voltage circuit (not shown).

The scanning driver 2 and the data driver 3 are disposed around the liquid crystal display panel 1. The four-color converter 4 is connected to the data driver 3. The four-color converter 4 receives an original red-green-blue (RGB) data having three data of the three colors, and utilizes the original RGB data to obtain a red-green-blue-white (RGBW) data required to be displayed. The original RGB data is provided by an external host computer or a graphic controller (not shown). The data driver 3 receives and processes the RGBW data generated from the four-color converter 4 to generate analog type signals (e.g., analog voltages), and provides the analog signals to the data lines S1 to Sn.

The scanning driver 2 sequentially provides multiple scanning signals to the scanning lines G1 to Gm. The data driver 3 and the scanning driver 2 respectively provide the analog type data signals and the scanning signals to the liquid crystal display panel 1. At the same time, the liquid crystal display panel 1 displays colors through the backlight (e.g., a blue light) generated by the backlight module (not shown).

The four-color converter 4 includes a grayscale conversion section 41, a white balance section 42, the comparing section 43, a first determination section 44, a white determination section 45, a three-color calculation section 46, a second determination section 47.

The grayscale conversion section 41 receives the original RGB data, and converts the original RGB data into three grayscale values of the three colors, that is, the grayscale value of the red (R) color, the grayscale value of the green (G) color, the grayscale value of the blue (B) color.

The white balance section 42 receives the three grayscale values of the three colors from the grayscale conversion section 41, and executes a white balance process to obtain three white-balanced grayscale values of the three colors. Here, Ri represents the white-balanced grayscale value of the red color, Gi represents the white-balanced grayscale value of the green color, and Bi represents the white-balanced grayscale value of the blue color.

The comparing section 43 receives the three white-balanced grayscale values of the three colors from the white balance section 42, and compares the three white-balanced grayscale values of the three colors in order to determine maximum and minimum values of the three white-balanced grayscale values of the three colors. Wherein, the maximum value is a maximum value of the three white-balanced grayscale values of the three colors, and is expressed as MAX (Ri, Gi, Bi). The minimum value is a minimum value of the three white-balanced grayscale values of the three colors, and is expressed as MIN (Ri, Gi, Bi).

The first determination section 44 receives the MIN (Ri, Gi, Bi) from the comparing section 43, and determines that if the MIN (Ri, Gi, Bi) is greater than 0 or equal to 0. When the first determination section 44 determines that the MIN (Ri, Gi, Bi) is greater than 0, the second determination section 47 receives the original RGB data and determines that if the three data of the original RGB data are equal, that is, the second determination section 47 determines that if the original R data, the original G data, and the original B data are equal in order to determine that if the original RGB data is a white color data.

If the second determination section 47 determines that the original R data, the original G data, and the original B data are equal, the original RGB data is confirmed to be the white color data. The white determination section 45 receives the white-balanced grayscale value of the B color generated from the white balance section 42, and set the white balanced grayscale value of the B color as an output grayscale value of the W color in the RGBW data required to be displayed, that is, Wo=Bi. Wherein, the Wo represents the output grayscale value of the W color in the RGBW data required to be displayed.

The three-color calculation section 46 receives output grayscale value of the W color in the RGBW data required to be displayed from the white determination section 45, and receives the white-balanced grayscale values of the three colors from white balance section 42, and receives the MAX (Ri, Gi, Bi) from the comparing section 43. The three-color calculation section 46 also calculates an output grayscale value of the R color, an output grayscale value of the G color, and an output grayscale value of the B color according to the output grayscale value of the W color, the three white-balanced grayscale values of the three colors, and the MAX (Ri, Gi, Bi). The three-color calculation section 46 utilizes the following formula 1 to calculate the three output grayscale values of the three colors in the RGBW required to be displayed.

$$Ro=Ri\times Wo/\mathrm{MAX}(Ri,Gi,Bi)+Ri-Wo$$

$$Go=Gi\times Wo/\mathrm{MAX}(Ri,Gi,Bi)+Gi-Wo$$

$$Bo=0 \quad \text{[Formula 1]}$$

Wherein, Ro represents the output grayscale value of the R color in the RGBW data required to be displayed, Go represents the output grayscale value of the G color in the RGBW data required to be displayed, and Bo represents the output grayscale value of the B color in the RGBW data required to be displayed.

When the first determination section 44 determines that the minimum value MIN (Ri, Gi, Bi) is greater than 0, if the second determination section 47 determines that the three data of the original RGB data are not equal, that is, at least two of the original R data, the original G data, and the original B data are not equal, the original RGB data is confirmed to be not the white color data. The white determination section 45 receives the maximum value MAX (Ri, Gi, Bi) from the comparing section 43, and utilizes the following formula 2 to calculate the output grayscale value of the white color in the RGBW data required to be displayed.

$$Wo=\mathrm{MAX}^2(Ri,Gi,Bi)/255 \quad \text{[Formula 2]}$$

Wherein, the Wo represents the output grayscale values of the W color in the RGBW data required to be displayed.

The three-color calculation section 46 receives the output grayscale value of the W color in the RGBW data required to be displayed from the white determination section 45, and receives the white-balanced grayscale values of the three colors from white balance section 42, and receives the MAX (Ri, Gi, Bi) from the comparing section 43. The three-color calculation section 46 also calculates an output grayscale value of the R color, an output grayscale value of the G color, and an output grayscale value of the B color according to the output grayscale value of the W color, the three white-balanced grayscale values of the three colors, and the MAX (Ri, Gi, Bi). The three-color calculation section 46 utilizes a following formula 3 to calculate the output grayscale values of the three colors in the RGBW required to be displayed.

$$Ro=Ri\times Wo/\mathrm{MAX}(Ri,Gi,Bi)+Ri-Wo$$

$$Go=Gi\times Wo/\mathrm{MAX}(Ri,Gi,Bi)+Gi-Wo$$

$$Bo=Bi\times Wo/\mathrm{MAX}(Ri,Gi,Bi)+Bi-Wo \quad \text{[Formula 3]}$$

When the first determination section 44 determines that the minimum value MIN (Ri, Gi, Bi) is equal to 0, the white determination section 45 set the output grayscale value of the W color in the RGBW data required to be displayed to be 0, that is, Wo=0, wherein, the Wo represents the output grayscale values of the W color in the RGBW data required to be displayed.

The three-color calculation section 46 receives the white-balanced grayscale values of the three colors from white balance section 42. The three-color calculation section 46 also calculates an output grayscale value of the R color, an output grayscale value of the G color, and an output grayscale value of the B color according to the three white-balanced grayscale values of the three colors. The three-color calculation section 46 utilizes a following formula 4 to calculate the output grayscale values of the three colors (R, G, B) in the RGBW required to be displayed.

$$Ro=Ri$$

$$Go=Gi$$

$$Bo=Bi \quad \text{[Formula 4]}$$

Figure 6:
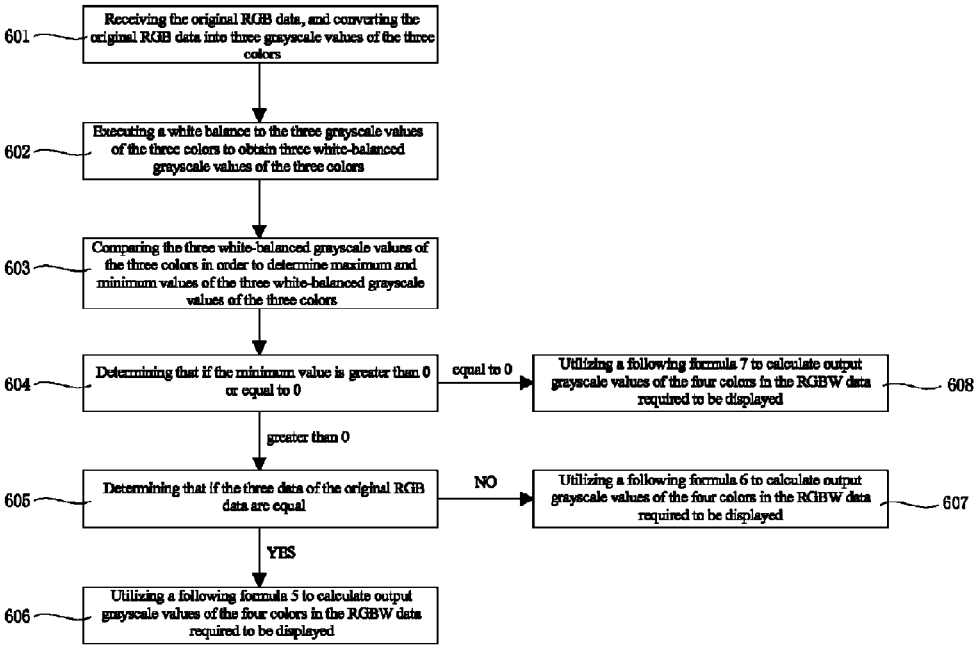
FIG. 6 is a flowchart of conversion method for converting a RGB data to a RGBW data according to an embodiment of the present invention.

FIG. 6 is a flowchart of conversion method for converting a red-green-blue (RGB) data to a red-green-blue-white (RGBW) data according to an embodiment of the present invention.

With reference to FIG. 6, in a step 601, receiving the original RGB data having three data of the three colors, and converting the original RGB data into three grayscale values of the three colors. Wherein, the three colors include a red color, a green color, and a blue color.

In a step 602, executing a white balance to the three grayscale values of the three colors to obtain three white-balanced grayscale values of the three colors.

In a step 603, comparing the three white-balanced grayscale values of the three colors in order to determine maximum and minimum values of the three white-balanced grayscale values of the three colors.

In a step 604, determining that if the minimum value is greater than 0 or equal to 0. If the minimum value is greater than 0, performing a step 605. If the minimum value is equal to 0, performing a step 608.

In the step 605, determining that if the three data of the original RGB data are equal. If the three data of the original RGB data are equal, performing a step 606. If the three data of the original RGB data are not equal, performing a step 607.

In the step 606, utilizing a following formula 5 to calculate output grayscale values of the four colors in the RGBW data required to be displayed.

$$Wo=Bi$$

$$Ro=Ri\times Wo/\mathrm{MAX}(Ri,Gi,Bi)+Ri-Wo$$

$$Go=Gi\times Wo/\mathrm{MAX}(Ri,Gi,Bi)+Gi-Wo$$

$$Bo=0 \quad \text{[Formula 5]}$$

Wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color.

In the step 607, utilizing a following formula 6 to calculate output grayscale values of the four colors in the RGBW data required to be displayed.

$$Wo=\mathrm{MAX}^2(Ri,Gi,Bi)/255$$

$$Ro=Ri\times Wo/\mathrm{MAX}(Ri,Gi,Bi)+Ri-Wo$$

$$Go=Gi\times Wo/\mathrm{MAX}(Ri,Gi,Bi)+Gi-Wo$$

$$Bo=Bi\times Wo/\mathrm{MAX}(Ri,Gi,Bi)+Bi-Wo \quad \text{[Formula 6]}$$

In the step 608, utilizing a following formula 7 to calculate output grayscale values of the four colors in the RGBW data required to be displayed.

$$Wo=0$$

$$Ro=Ri$$

$$Go=Gi$$

$$Bo=Bi \quad \text{[Formula 7]}$$

In summary, the present invention enables each subpixel of the liquid crystal display panel satisfies the relation W=R+G+B when displaying. In addition, the liquid crystal display panel displays the spectrum of the white color in the normal range and the chromaticity of white color being displayed is normal.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A liquid crystal display device, comprising:

a four-color converter for converting an original red-green-blue (RGB) data having three data of the three colors into three grayscale values of the three colors, executing a white balance process to the three grayscale values of the three colors, and confirming maximum and minimum values of the three white-balanced grayscale values of the three colors, wherein, when the minimum value is greater than 0, determining that if the three data of the original RGB data are equal, and when the three data of the original RGB data are equal, utilizing a following formula 1 to calculate output grayscale values of four colors in a red-green-blue-white (RGBW) data required to be displayed, $$Wo=Bi;$$

$$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=0; \quad \text{[formula 1]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color, a data driver configured for processing the RGBW data provided by the four-color converter in order to generate analog type data signals;

a scanning driver configured for sequentially generating scanning signals; and a liquid crystal panel for displaying colors by the analog type data signals provided by the data driver and the scanning signals provided by the scanning driver.

2. The liquid crystal display device according to claim 1, wherein, the four-color converter is further configured to calculate the output grayscale values of the four colors in the RGBW data required to be displayed utilizing the following formula 2 when the minimum value is greater than 0, and at least two data of the original RGB data are not equal, $$Wo=\mathrm{MAX}^2(Ri,Gi,Bi)/255;$$

$$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=Bi\times Wo/\mathrm{MAX}(Ri,Gi,Bi)+Bi-Wo; \quad \text{[formula 2]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color.

3. The liquid crystal display device according to claim 1, wherein, the four-color converter is further configured to calculate the output grayscale values of the four colors in the RGBW data required to be displayed utilizing the following formula 3 when the minimum value is equal to 0, $$Wo=0;$$

$$Ro=Ri;$$

$$Go=Gi;$$

$$Bo=Bi; \quad \text{[formula 3]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; Ri represents the white-balanced grayscale value of the red color; Gi represents the white-balanced grayscale value of the green color; and Bi represents the white-balanced grayscale value of the blue color.

4. A four-color converter, comprising:

a grayscale conversion section configured for receiving an original red-green-blue (RGB) data having three data of the three colors, and converting the original RGB data into three grayscale values of the three colors;

a white balance section configured receiving the three grayscale values of the three colors from the grayscale conversion section, and executing a white balance process to obtain three white-balanced grayscale values of the three colors;

a comparing section configured for comparing the three white-balanced grayscale values of the three colors in order to determine maximum and minimum values of the three white-balanced grayscale values of the three colors;

a first determination section configured for determining that if the minimum value is greater than 0 or equal to 0;

a second determination section configured for determining that if the three data of the original RGB data are equal when the first determination section determines that the minimum value by is greater than 0;

a white determination section configured for setting the white-balanced grayscale value of the blue color as an output grayscale value of the white color in a red-green-blue-white (RGBW) data required to be displayed when the second determination section determines that the three data of the original RGB data are equal; and a three-color calculation section configured for calculating three output grayscale values of the three colors in the RGBW data required to be displayed by utilizing a following formula 1, $$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=0; \quad \text{[formula 1]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color.

5. The four-color converter according to claim 4, wherein, the white determination section is further configured for calculating the output grayscale value of the white color in the RGBW data required to be displayed by utilizing a following formula 2 when second determination section determines that at least two data of the original RGB data are not equal, $$Wo=\mathrm{MAX}^2(Ri,Gi,Bi)/255; \text{ and} \quad \text{[formula 2]}$$

the three-color calculation section is further configured for calculating the three output grayscale values of the three colors in the RGBW data required to be displayed by utilizing a following formula 3, $$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=Bi\times Wo/\mathrm{MAX}(Ri,Gi,Bi)+Bi-Wo; \quad \text{[formula 3]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color.

6. The four-color converter according to claim 4, wherein, the white determination section is further configured for calculating the output grayscale value of the white color in the RGBW data required to be displayed by utilizing a following formula 4 when the minimum value is equal to 0, $$Wo=0; \text{ and} \quad \text{[formula 4]}$$

the three-color calculation section is further configured for calculating the three output grayscale values of the three colors in the RGBW data required to be displayed by utilizing a following formula 5, $$Ro=Ri;\ Go=Gi;\ Bo=Bi; \quad \text{[formula 5]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; Ri represents the white-balanced grayscale value of the red color, Gi represents the white-balanced grayscale value of the green color; and Bi represents the white-balanced grayscale value of the blue color.

7. A conversion method for converting a red-green-blue (RGB) data to a red-green-blue-white (RGBW) data, comprising:

receiving an original red-green-blue (RGB) data having three data of the three colors, and converting the original RGB data into three grayscale values of the three colors, wherein, the three colors include a red color, a green color, and a blue color, executing a white balance process to the three grayscale values of the three colors to obtain three white-balanced grayscale values of the three colors;

comparing the three white-balanced grayscale values of the three colors in order to determine maximum and minimum values of the three white-balanced grayscale values of the three colors;

determining that if the minimum value is greater than 0 or equal to 0;

if the minimum value is greater than 0, determining that if the three data of the original RGB data are equal; and if the three data of the original RGB data are equal, utilizing a following formula 1 to calculate output grayscale values of the four colors in the RGBW data required to be displayed, $$Wo=Bi;$$

$$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=0; \quad \text{[formula 1]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color.

8. The conversion method according to claim 7, wherein, if the minimum value is greater than 0 and at least two data of the original RGB data are not equal, utilizing a following formula 2 to calculate output grayscale values of the four colors in the RGBW data required to be displayed, $$Wo=\mathrm{MAX}^2(Ri,Gi,Bi)/255;$$

$$Ro=Ri\times Wo/\mathrm{MAX}(Ri,Gi,Bi)+Ri-Wo;$$

$$Go=Gi\times Wo/\mathrm{MAX}(Ri,Gi,Bi)+Gi-Wo;$$

$$Bo=Bi\times Wo/\mathrm{MAX}(Ri,Gi,Bi)+Bi-Wo; \quad \text{[formula 2]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; the MAX (Ri, Gi, Bi) represents the maximum value of the white-balanced grayscale values of the three colors; Ri represents the white-balanced grayscale value of the red color; Gi represents the white-balanced grayscale value of the green color; and Bi represents the white-balanced grayscale value of the blue color.

9. The conversion method according to claim 7, wherein, if the minimum value is equal to 0, utilizing a following formula 3 to calculate output grayscale values of the four colors in the RGBW data required to be displayed, $$Wo=0;\ Ro=Ri;\ Go=Gi;\ Bo=Bi; \quad \text{[formula 3]}$$

wherein, Ro represents the output grayscale value of the red color in the RGBW data required to be displayed; Go represents the output grayscale value of the green color in the RGBW data required to be displayed; Bo represents the output grayscale value of the blue color in the RGBW data required to be displayed; Wo represents the output grayscale value of the white color in the RGBW data required to be displayed; Ri represents the white-balanced grayscale value of the red color, Gi represents the white-balanced grayscale value of the green color; and Bi represents the white-balanced grayscale value of the blue color.

* * * * *